US011781086B2

(12) United States Patent
Ward et al.

(10) Patent No.: US 11,781,086 B2
(45) Date of Patent: Oct. 10, 2023

(54) LUBRICATING OILS AND GREASES

(71) Applicant: EQUUS UK TOPCO LTD, Goole (GB)

(72) Inventors: Claire Anne Ward, East Yorkshire (GB); Alexei Nikolaevich Kurchan, Plainsboro, NJ (US)

(73) Assignee: EQUUS UK TOPCO LTD, Goole (GB)

( * ) Notice: Subject to any disclaimer, the term of this patent is extended or adjusted under 35 U.S.C. 154(b) by 0 days.

(21) Appl. No.: 17/459,616

(22) Filed: Aug. 27, 2021

(65) Prior Publication Data

US 2022/0010233 A1 Jan. 13, 2022

Related U.S. Application Data

(63) Continuation-in-part of application No. 15/310,988, filed as application No. PCT/US2015/030771 on May 14, 2015, now Pat. No. 11,104,860.

(60) Provisional application No. 61/993,520, filed on May 15, 2014.

(51) Int. Cl.

| | |
|---|---|
| ***C10M 169/00*** | (2006.01) |
| ***C10M 107/02*** | (2006.01) |
| ***C10M 111/04*** | (2006.01) |
| ***C10M 129/76*** | (2006.01) |
| ***C10M 135/18*** | (2006.01) |
| ***C10M 141/08*** | (2006.01) |
| ***C10M 117/04*** | (2006.01) |
| ***C10M 105/68*** | (2006.01) |
| *C10N 40/02* | (2006.01) |
| *C10N 50/10* | (2006.01) |
| *C10N 40/04* | (2006.01) |

(52) U.S. Cl.

CPC ..... *C10M 169/00* (2013.01); *C10M 105/68* (2013.01); *C10M 107/02* (2013.01); *C10M 111/04* (2013.01); *C10M 117/04* (2013.01); *C10M 129/76* (2013.01); *C10M 135/18* (2013.01); *C10M 141/08* (2013.01); *C10M 2205/0206* (2013.01); *C10M 2207/128* (2013.01); *C10M 2207/283* (2013.01); *C10M 2215/285* (2013.01); *C10M 2219/068* (2013.01); *C10N 2040/02* (2013.01); *C10N 2040/04* (2013.01); *C10N 2050/10* (2013.01)

(58) Field of Classification Search

CPC ..... C10M 169/00; C10M 105/68; C10M 107/02; C10M 111/04; C10M 117/04; C10M 129/76; C10M 135/18; C10M 141/08; C10M 2205/0206; C10M 2207/128; C10M 2207/283; C10M 2215/285; C10M 2219/068; C10M 169/06; C10M 133/16; C10M 2201/087; C10M 2201/105; C10M 2205/0285; C10M 2207/1265; C10M 2207/289; C10M 2207/401; C10M 2215/08; C10M 2217/0456; C10M 2229/041; C10N 2040/02; C10N 2040/04; C10N 2050/10

USPC ..... 508/364

See application file for complete search history.

(56) References Cited

U.S. PATENT DOCUMENTS

| | | | | |
|---|---|---|---|---|
| 2,686,811 | A | 8/1954 | Bull | |
| 3,278,612 | A | 10/1966 | Greene | |
| 3,312,620 | A | 4/1967 | Low et al. | |
| 3,827,981 | A | 8/1974 | Thompson. | |
| 3,894,958 | A * | 7/1975 | McCoy | C10M 169/00 508/555 |
| 3,910,847 | A | 10/1975 | Thompson | |
| 3,915,876 | A | 10/1975 | Thompson | |
| 3,953,346 | A | 4/1976 | Thompson | |
| 4,096,077 | A | 6/1978 | Swakon | |
| 4,207,263 | A | 6/1980 | Hoffmann et al. | |
| 4,289,636 | A | 9/1981 | Davis et al. | |
| 4,425,248 | A | 1/1984 | Piotrowski et al. | |
| 4,579,673 | A | 4/1986 | Piotrowski et al. | |
| 4,992,188 | A | 2/1991 | Jolley | |
| 5,194,171 | A | 3/1993 | Jolley | |
| 9,562,207 | B2 | 2/2017 | DeBlase et al. | |
| 2007/0027044 | A1 | 2/2007 | Le Coent | |
| 2007/0232833 | A1 | 10/2007 | Haese et al. | |
| 2009/0131293 | A1 | 5/2009 | Ma et al. | |

(Continued)

FOREIGN PATENT DOCUMENTS

| | | |
|---|---|---|
| DE | 202009016945 U1 | 3/2010 |
| EP | 0188786 A1 | 7/1988 |

(Continued)

OTHER PUBLICATIONS

Chinese Office Action far Chinese Application No. 201580025931.X, dated Oct. 24. 2018, with translation, 21 pages.

(Continued)

*Primary Examiner* — Prem C Singh
*Assistant Examiner* — Francis C Campanell

(57) ABSTRACT

A lubricating oil composition comprises an amide and at least one additive. A lubricating grease composition comprises a liquid amide, a thickener comprising a metal soap, and at least one additive. The amide in each composition is the reaction product of a secondary, branched amine and a carboxylic acid. The carboxylic acid may be a monocarboxylic acid or a dicarboxylic acid, including dimer acid. The amide is hydrolytically stable, and may be used to increase the hydrolytic stability of the lubricant oil or grease composition. Alternatively, the amide may be used to increase the additive solubility or detergency of the lubricant oil or grease composition.

15 Claims, No Drawings

(56) References Cited

U.S. PATENT DOCUMENTS

| | | | | |
|---|---|---|---|---|
| 2012/0004153 | A1* | 1/2012 | Beret | C10M 117/02 508/591 |
| 2014/0045733 | A1* | 2/2014 | Nogami | C10M 141/12 508/378 |

FOREIGN PATENT DOCUMENTS

| | | | |
|---|---|---|---|
| EP | 1876285 | A1 | 1/2008 |
| JP | 4970917 | A | 7/1974 |
| JP | 524968 | A | 1/1977 |
| KR | 20080086401 | A | 9/2008 |

OTHER PUBLICATIONS

International Preliminary Report on Patentability and Written Opinion for International Application No. PCT/US2015/030771, dated Nov. 15, 2016, 8 pages.
International Search Report for International Application No. PCT/US2015/030771, dated Oct. 8, 2015, 3 pages.
Korean Notification of Reason for Refusal for Korean Application No. 10-2016-7034739, dated May 28, 2028 with translation, 15 pages.
Notice of Reasons for Rejection for Japanese Application No. 2016-567592, dated Jan. 15, 2019, with translation, 6 pages.

* cited by examiner

LUBRICATING OILS AND GREASES

CROSS REFERENCE TO RELATED APPLICATION

This application is a continuation-in-part of U.S. application Ser. No. 15/310,988, filed Nov. 14, 2016, which is a 371 filing of PCT/US2015/030771, filed May 14, 2015, which claims priority to U.S. Provisional Application No. 61/993,520, filed May 15, 2014, the entire disclosures of which are incorporated herein by reference in their entireties for all purposes.

FIELD OF THE INVENTION

The present invention relates to a lubricant composition and to a grease composition. The lubricant composition may be used in the automotive, marine, industrial, compressor, refrigeration or other lubrication fields. The grease composition may be used on both radical and thrust bearings of which there are numerous varieties such as plain, roller, ball, tapered, journal and needle bearings, cantilever bosses, cables, ropes, seat posts, threads, and stems. In particular, the present invention relates to a lubricant composition or to a grease composition comprising an amide, more preferably an oil-soluble liquid amide, as the base fluid or as an additive.

BACKGROUND

Lubricant compositions typically comprise a lubricant base stock and an additive package, both of which can contribute significantly to the properties and performance of the lubricant composition.

The choice of lubricant base stock can have a major impact on properties such as oxidation and thermal stability, volatility, low temperature fluidity, solvency of additives, contaminants and degradation products, and traction. The American Petroleum Institute (API) currently defines five groups of lubricant base stocks (API Publication 1509) for automotive engine oils.

Groups I, II and III are mineral oils which are classified by the amount of saturates and sulphur they contain and by their viscosity indices. Table 1 below illustrates these API classifications for Groups I, II and III.

TABLE 1

| Group | Saturates | Sulphur | Viscosity Index (VI) |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. The use of Group II stocks has grown to about 30% of the US market. Group III base stocks are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks e.g. polyalphaolefins (PAOs). PAOs have good oxidative stability, volatility and low pour points. Disadvantages include moderate solubility of polar additives, for example antiwear additives.

Group V base stocks are all base stocks that are not included in Groups I to IV. Examples include alkyl naphthalenes, alkyl aromatics, vegetable oils, esters (including polyol esters, diesters and monoesters), polycarbonates, silicone oils and polyalkylene glycols.

To create a suitable lubricant composition, additives are blended into the chosen base stock. The additives either enhance the stability of the lubricant base stock or provide additional functionalities to the composition. Examples of automotive engine oil additives include antioxidants, antiwear agents, detergents, dispersants, viscosity index improvers, defoamers, pour point depressants and friction reducing additives.

Many lubricant base stocks and additives are based on esters; including monoesters, diesters and polyol esters. These ester compounds provide good properties, for example kinematic viscosities and viscosity indices, for lubricant compositions. However, the presence and nature of the ester group (—COO—) in these compounds leads to hydrolysis in systems where water may be present, and/or oxidation or thermal degradation in systems which are subjected to high temperatures.

Greases are semisolid lubricants with a complex multiphase structure, that provide a barrier against undesired materials, e.g., water and debris. In the last 25 years, the significant progress made in machine design has impacted operating parameters and the particular requirements for lubricating greases. Variations in equipment operating parameters (e.g., speed, load and temperature) makes it practically impossible for a single universal grease composition to perform satisfactorily in all applications. As a result, many lubricating greases have been developed and are currently on the market.

Lubricating greases are typically composed of a thickener, a base oil and performance additives. The thickener is usually a metal soap of a long chain fatty acid and gives the grease its properties such as water resistance, and determines the grease type. For example, if the thickener is lithium stearate, the grease type will be a lithium grease. The most popular greases worldwide are lithium-based greases, but non-soap-based clay, fumed silica, poly-urea and polymer thickeners can also be used. A multi-purpose grease is defined as a grease combining the properties of two or more specialized greases, such as a lithium grease and a calcium grease, that can be applied in more than one application. Because of their compatibility with most widely used lithium greases, lithium-complex and calcium-sulfonate greases are examples of high-performance multi-purpose greases. Unlike lithium-complex greases, which require a significant amount of additives, calcium-sulfonate thickeners exhibit inherent extreme-pressure and anti-wear properties. Furthermore, calcium sulfonate, by virtue of its thickener properties, provides excellent water-resistance properties and does not break down even in the presence of water. To improve their water-resistance properties, lithium-complex greases usually require tackifiers. There exists, therefore, a need for a lubricant composition and a grease composition which exhibits good hydrolytic stability, as well as possessing favourable physical properties for use in lubrication applications.

SUMMARY OF THE INVENTION

It is an object of the present invention to address the above and/or other disadvantages associated with the prior art.

Thus, according to a first aspect of the present invention, there is provided a lubricating composition comprising:

a) an amide which is the reaction product of a secondary, branched amine and a carboxylic acid; and b) at least one additive.

According to a second aspect of the present invention, there is provided a method of increasing the additive solubility or detergency of a lubricant composition which comprises using a lubricant composition comprising:

a) an amide which is the reaction product of a secondary, branched amine and a carboxylic acid; and b) at least one additive.

In a preferred aspect, there is provided a method of increasing the additive solubility of a lubricant composition which comprises using a lubricant composition comprising:

a) an amide which is the reaction product of a secondary, branched amine and a carboxylic acid; and b) at least one additive.

By the use of the term "additive solubility" as used herein, it is meant the ability of the additive or additives to dissolve within the lubricant composition to produce a clear, i.e. non-hazy, non-separated and sediment free, solution.

According to a third aspect of the present invention, there is provided the use of an amide which is the reaction product of a secondary, branched amine and a carboxylic acid to increase the additive solubility or detergency of a lubricant composition.

According to a further aspect of the present invention, there is provided the use of an amide which is the reaction product of a secondary, branched amine and a carboxylic acid to produce a hydrolytically stable lubricant composition.

The lubricant composition described herein can be used as an automotive or marine engine oil, an automotive or marine gear or transmission oil, an industrial gear oil or turbine oil, a hydraulic oil, a compressor oil, a cutting oil, a rolling oil, a drilling oil, a refrigeration oil and the like.

In an exemplary embodiment, the amide of the lubricating composition is an amide of Formula (Ia) or (Ib):

(Ia)

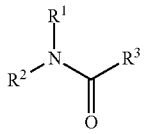

(Ib)

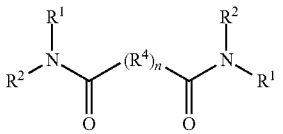

wherein:

$R^1$ and $R^2$ are independently selected from the group consisting of $C_3$ to $C_{18}$ linear or branched, saturated or unsaturated, hydrocarbyl groups;

$R^3$ is selected from the group consisting of $C_3$ to $C_{50}$ linear or branched, saturated or unsaturated hydrocarbyl groups;

$R^4$ is selected from the group consisting of $C_1$ to $C_{50}$ linear or branched, saturated or unsaturated hydrocarbylene groups; and n is 0 or 1, wherein at least one of $R^1$ and $R^2$ is branched.

In an exemplary embodiment, the secondary, branched amine reactant of the lubricating composition has the formula (II):

(II)

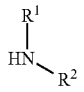

wherein $R^1$ and $R^2$ are independently selected from the group consisting of $C_3$ to $C_{18}$ linear or branched, saturated or unsaturated, hydrocarbyl groups, and wherein at least one of $R^1$ and $R^2$ is branched.

In an exemplary embodiment, the carboxylic acid of the lubricating composition is a monocarboxylic acid and the amide is a monoamide.

In an exemplary embodiment, the monocarboxylic acid of the lubricating composition comprises from 4 to 36 carbon atoms.

In an exemplary embodiment, the carboxylic acid of the lubricating composition is a dicarboxylic acid and the amide is a diamide.

In an exemplary embodiment, the dicarboxylic acid of the lubricating composition comprises from 2 to 14 carbon atoms or from 24 to 52 carbon atoms.

In an exemplary embodiment, the neat amide of the lubricating composition has a hydrolytic stability measured according to the method set out in ASTM D943 of at least 40 hours.

In an exemplary embodiment, the lubricating composition comprises at least 1 wt % and up to 99.9 wt % amide based on the total weight of the composition.

In an exemplary embodiment, the lubricating composition comprises at least 0.1 wt % and up to 40 wt % of said at least one additive based on the total weight of the composition.

In an exemplary embodiment, the lubricant composition comprises a further base oil.

In an exemplary embodiment, the lubricant composition comprises at least 1 wt % and up to 98.9 wt % of further base oil based on the total weight of the composition.

In an exemplary embodiment, a method of increasing the additive solubility or detergency of a lubricant composition comprises adding to the lubricant composition: a) an amide which is the reaction product of a secondary, branched amine and a carboxylic acid; and b) at least one additive.

In an exemplary embodiment, a method of producing a hydrolytically stable lubricant composition comprises: a) reacting a secondary, branched amine and a carboxylic acid to form an amide; and b) adding at least one additive to the amide.

According to another aspect of the present invention, there is provided a grease composition comprising: a) a base oil comprising a liquid amide which is the reaction product of a secondary, branched amine and a carboxylic acid; b) a thickener; and c) optionally at least one additive.

According to yet another aspect of the present invention, there is provided a method of increasing the additive solubility and/or detergency and/or hydrolytic stability of a grease composition which comprises using a grease composition comprising: a) a base oil comprising a liquid amide which is the reaction product of a secondary, branched amine and a carboxylic acid; b) a thickener; and c) optionally at least one additive.

In an exemplary embodiment, the thickener is a salt of a long chain fatty acid, such as a metal salt of a long chain fatty acid (i.e., a metal soap), such as where the fatty acids include, but are not limited to, stearic acids (such as 12-hydroxy stearic acid), lauric acids, ricinoleic acids and octylic acids, and where the metals include, but are not limited to, lithium, sodium, potassium, magnesium, calcium, barium, zinc, and aluminum.

In an exemplary embodiment, an alternative (or modified) type of thickener may be used, where the thickener contains a free OH group. In a particular embodiment, the alternative thickener is the combination of the metal salt thickener described above in combination with a complexing agent (i.e., a dicarboxylic acid to introduce free OH groups). Use of the complexing agent provides "a complex grease", which is a more structured grease than that obtained when the complexing agent is omitted. Complex greases are more desirable for high temperature applications. In the present invention, the presence of a thickener is essential to provide a grease, but the presence of the complexing agent to provide a complex grease is optional depending on the environment in which the grease is present.

Suitable dicarboxylic acids include, but are not limited to glutaric, adipic, pimelic, octanedioic, sebacic and dodecanedioic acids.

In an exemplary embodiment, the base oil is present in the grease formulation in an amount of 1 to 99 wt %, such as 5 to 99 wt %, such as 10 to 95 wt %, such as 20 to 95 wt %, such as 30 to 95 wt %, such as 40 to 95 wt %, such as 50 to 95 wt %, such as 60 to 95 wt %, such as 70 to 95 wt %, such as 80 to 95 wt %, such as 30 to 90 wt %, such as 40 to 90 wt %, such as 50 to 90 wt %, such as 60 to 90 wt %, such as 70 to 90 wt %, such as 40 to 85 wt %, such as 50 to 85 wt %, such as 60 to 85 wt %.

In an exemplary embodiment, the thickener is present in the grease formulation in an amount of 5 to 30 wt %, such as 5 to 25 wt %, such as 5 to 20 wt %, such as 5 to 15 wt %, such as 10 to 30 wt %, such as 10 to 25 wt %, such as 10 to 20 wt %, such as 10 to 15 wt %, such as 15 to 30 wt %, such as 20 to 30 wt %.

In an exemplary embodiment, the base oil of the grease composition comprises a liquid amide of Formula (Ia) or (Ib)

(Ia)

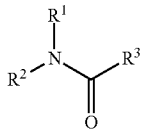

(Ib)

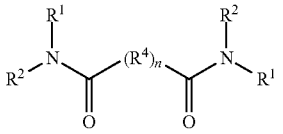

wherein:

$R^1$ and $R^2$ are independently selected from the group consisting of $C_3$ to $C_{18}$ linear or branched, saturated or unsaturated, hydrocarbyl groups;

$R^3$ is selected from the group consisting of $C_3$ to $C_{50}$ linear or branched, saturated or unsaturated hydrocarbyl groups;

$R^4$ is selected from the group consisting of $C_1$ to $C_{50}$ linear or branched, saturated or unsaturated hydrocarbylene groups; and n is 0 or 1, wherein at least one of $R^1$ and $R^2$ is branched.

In an exemplary embodiment, the base oil of the grease composition further comprises an oil that is different from the amides of Formula (Ia) and (Ib), such as an oil selected from a Group I-III mineral oil, poly-α-olefin (PAO) oil, a silicone oil, a synthetic hydrocarbon oil, an ester-based synthetic oil, an ether-based synthetic oil, and a glycol-based synthetic oil, vegetable oils and refined vegetable oils The different oil may be present in an amount of 1 to 98 wt % relative to the amides of Formula (Ia) and (Ib), such as 10 to 90 wt %, such as 20 to 90 wt %, such as 30 to 90 wt %, such as 40 to 90 wt %, such as 50 to 90 wt %, such as 60 to 90 wt %, such as 70 to 90 wt %. In an exemplary embodiment, the base oil of the grease composition comprises a mixture of 2 to 65 wt % of an amide of Formula (Ia) or (Ib) and 35 to 98 wt % of an oil different from the amides of Formula (Ia) and (Ib), such as 5 to 50 wt % of an amide of Formula (Ia) or (Ib) and 50 to 95 wt % of an oil different from the amides of Formula (Ia) and (Ib), such as 15 to 40 wt % of an amide of Formula (Ia) or (Ib) and 60 to 85 wt % of an oil different from the amides of Formula (Ia) and (Ib).

In an exemplary embodiment, the lubricating grease composition comprises (or consists of): a) a base oil comprising a liquid amide of Formula (Ia) or (Ib); b) a metal soap; and c) optionally at least one additive.

In an exemplary embodiment, the lubricating grease composition comprises (or consists of): a) a base oil comprising a liquid amide of Formula (Ia) or (Ib); b) a metal salt of a $C_{14}$ to $C_{22}$ fatty acid as a thickener; and c) optionally at least one additive.

In an exemplary embodiment, the lubricating grease composition comprises (or consists of): a) a base oil comprising a liquid amide of Formula (Ia) or (Ib) as a minor component and an oil different from the amides of Formula (Ia) and (Ib) as a major component; b) a metal soap; and c) optionally at least one additive.

In an exemplary embodiment, the lubricating grease composition comprises (or consists of): a) a base oil comprising a liquid amide of Formula (Ia) or (Ib) as a minor component and an oil different from the amides of Formula (Ia) and (Ib) as a major component; b) a metal salt of a $C_{14}$ to $C_{22}$ fatty acid as a thickener; and c) optionally at least one additive.

In an exemplary embodiment, the lubricating grease composition comprises (or consists of): a) a base oil comprising a liquid amide of Formula (Ia) or (Ib); b) a lithium, sodium, potassium, calcium, magnesium or aluminium salt of a $C_{14}$ to $C_{22}$ fatty acid or mixtures thereof as a thickener; and c) optionally at least one additive.

In an exemplary embodiment, the lubricating grease composition comprises (or consists of): a) a base oil comprising a liquid amide of Formula (Ia) or (Ib) as a minor component and an oil different from the amides of Formula (Ia) and (Ib) as a major component; b) a lithium, sodium, potassium, calcium, magnesium or aluminium salt of a $C_{14}$ to $C_{22}$ fatty acid or mixtures thereof as a thickener; and c) optionally at least one additive.

In an exemplary embodiment, the oil that is different from the liquid amides of Formula (Ia) or (Ib) is one or more selected from the group consisting of a poly-α-olefin (PAO) oil, a silicone oil, a vegetable oil, a synthetic hydrocarbon oil, an ester-based synthetic oil, an ether-based synthetic oil, and a glycol-based synthetic oil.

In an exemplary embodiment of the lubricating grease composition, the base oil comprising a liquid amide of Formula (Ia) or (Ib) is present in an amount greater than 0 wt % but less than 50 wt %, such as less than 40 wt %, such as less than 30 wt %, such as less than 20 wt %, such as less than 10 wt % compared to the presence of an oil that is different from the amides of Formula (Ia) and (Ib) as a major component, such as one or more of a poly-α-olefin (PAO) oil, a vegetable oil, a silicone oil, a synthetic hydrocarbon oil, an ester-based synthetic oil, an ether-based synthetic oil, and a glycol-based synthetic oil.

In an exemplary embodiment, the lubricating grease composition comprises (or consists of): a) a base oil comprising 5-30 wt % of a liquid amide of Formula (Ia) or (Ib) and 50-80 wt % of an oil that is different from the liquid amide of Formula (Ia) or (Ib); b) 10-30 wt % of thickener; and c) 0-15 wt % of an additive, wherein the wt % is relative to the total weight of the grease composition.

DETAILED DESCRIPTION OF THE INVENTION

The base oil comprises an amide which is the reaction product of a secondary, branched amine and a carboxylic acid and is a tertiary amide. Preferably, the amide is sterically hindered. By the term "sterically hindered", it is meant that the amide group, —NCO—, is bonded to large and/or branched moieties which shield the amide group from further reaction. A "large" group can be taken to mean any branched or linear hydrocarbyl chain. Preferably, base oil of the lubricant and the grease compositions of the present invention comprise an amide of Formula (Ia) or (Ib):

(Ia)

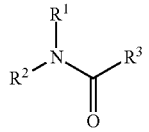

(Ib)

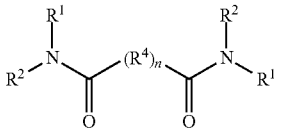

wherein:

$R^1$ and $R^2$ are independently selected from the group consisting of $C_3$ to $C_{18}$ linear or branched, saturated or unsaturated, hydrocarbyl groups;

$R^3$ is selected from the group consisting of $C_3$ to $C_{50}$ linear or branched, saturated or unsaturated hydrocarbyl groups;

$R^4$ is selected from the group consisting of $C_1$ to $C_{50}$ linear or branched, saturated or unsaturated hydrocarbylene groups; and n is 0 or 1, wherein at least one of $R^1$ and $R^2$ is branched.

By the term "hydrocarbyl group" as used herein, it is meant an acyclic or cyclic functional group consisting only of carbon and hydrogen atoms which is the fragment, containing an open point of attachment on a carbon atom, that would form if a hydrogen atom bonded to a carbon atom is removed from the molecule of a hydrocarbon. The definition of the term "hydrocarbyl group" when used herein includes alkyl (saturated), alkenyl (containing a carbon-carbon double bond) and alkynyl (containing a carbon-carbon triple bond) groups. Preferably, the hydrocarbyl groups referred to herein are alkyl or alkenyl groups, more preferably alkyl groups. Preferably, the hydrocarbyl groups referred to herein are acyclic. By the term "hydrocarbylene group" as used herein, it is meant an acyclic or cyclic functional group consisting only of carbon and hydrogen atoms which is the fragment, containing two open points of attachment on a carbon atom, or one open point of attachment each on two separate carbon atoms, that would form if two hydrogen atoms were removed from the molecule of a hydrocarbon. The definition of the term "hydrocarbylene group" when used herein includes alkylene (saturated), alkenylene (containing a carbon-carbon double bond) and alkynylene groups (containing a carbon-carbon triple bond). Preferably, the hydrocarbylene groups referred to herein are alkylene or alkenylene groups, more preferably alkylene groups. Preferably, the hydrocarbylene groups referred to herein are acyclic. Preferably, the open points of attachment on the hydrocarbylene groups are on the terminal carbon atoms of the hydrocarbylene chain.

The groups $R^1$ and $R^2$ are both present in the secondary, branched amine reactant. The groups $R^3$ and $R^4$, when present, are present in the carboxylic acid reactant.

Preferably, $R^1$ and $R^2$ are independently of each other $C_3$ to $C_{15}$ hydrocarbyl groups, more preferably $C_3$ to $C_{13}$ hydrocarbyl groups, and most preferably $C_3$ to $C_{10}$ hydrocarbyl groups.

Preferably, $R^1$ and $R^2$ are independently of each other $C_3$ to $C_{15}$ alkyl groups, more preferably $C_3$ to $C_{13}$ alkyl groups, and most preferably $C_3$ to $C_{10}$ alkyl groups.

Preferably both $R^1$ and $R^2$ are branched. Preferably, both $R^1$ and $R^2$ are saturated.

$R^1$ and $R^2$ may be the same or different. Preferably, $R^1$ and $R^2$ are the same as each other.

Preferably, both $R^1$ and $R^2$ are branched, saturated, $C_3$ to $C_{15}$ alkyl groups, more preferably $C_3$ to $C_{13}$ alkyl groups, most preferably $C_3$ to $C_8$ alkyl groups.

$R^3$ is preferably a $C_2$ to $C_{35}$ hydrocarbyl group, preferably a $C_3$ to $C_{23}$ hydrocarbyl group, more preferably a $C_5$ to $C_{21}$ hydrocarbyl group and most preferably a $C_6$ to $C_{17}$ hydrocarbyl group. $R^3$ is preferably a $C_2$ to $C_{35}$ alkyl or alkenyl group, preferably a $C_3$ to $C_{23}$ alkyl or alkenyl group, more preferably a $C_5$ to $C_{21}$ alkyl or alkenyl group and most preferably a $C_6$ to $C_{17}$ alkyl or alkenyl group. $R^3$ is preferably a $C_2$ to $C_{35}$ alkyl group, preferably a $C_3$ to $C_{23}$ alkyl group, more preferably a $C_5$ to $C_{21}$ alkyl group and most preferably a $C_6$ to $C_{17}$ alkyl group.

Preferably, $R^4$ is a $C_1$ to $C_{40}$ hydrocarbylene group, preferably a $C_1$ to $C_{16}$ or a $C_{24}$ to $C_{40}$ hydrocarbylene group, more preferably a $C_1$ to $C_{12}$ or a $C_{28}$ to $C_{38}$ hydrocarbylene group and most preferably a $C_1$ to $C_8$ or a $C_{34}$ hydrocarbylene group. $R^4$ is preferably a $C_1$ to $C_{40}$ alkylene or alkenylene group, preferably a $C_1$ to $C_{16}$ or a $C_{24}$ to $C_{40}$ alkylene or alkenylene group, more preferably a $C_1$ to $C_{12}$ or a $C_{28}$ to $C_{38}$ alkylene or alkenylene group and most preferably a $C_1$ to $C_8$ or a $C_{34}$ alkylene or alkenylene group. $R^4$ is preferably an alkylene group.

Preferably, n is 1.

Preferably, the secondary, branched amine reactant has the formula (II):

(II)

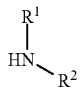

wherein $R^1$ and $R^2$ are as defined above, and wherein at least one of $R^1$ and $R^2$ is branched. Preferably, both $R^1$ and $R^2$ are both branched. More preferably, $R^1$ and $R^2$ are the same as each other.

Examples of suitable secondary, branched amine reactants include, but are not limited to, di-(2-ethylhexyl)amine (alternative names: (Di-2-EHA) or Bis-(2-ethylhexyl amine), available from OXEA and BASF), diisopropylamine (alternative names: N,N-Diisopropylamine or DIPA, produced as describe in U.S. Pat. No. 2,686,811), ditridecylamine (mixture of isomers) (available from BASF), and diisobutylamine (alternative names: Bis(2-methylpropyl)amine, Di-isobutylamine or N,N-Bis(2-methylpropyl)amine, available from BASF, Shanghai Hanhong Chemical Co., Ltd. and others), more preferably di-(2-ethylhexyl)amine or diisopropylamine.

Secondary amines suitable for use in the present invention are generally produced from corresponding alcohols, ketones or aldehydes and ammonia or primary amines, as described in following patents: U.S. Patent Application Publication No. 2007/0232833A1, U.S. Pat. No. 8,034,978B2, U.S. Pat. No. 4,207,263. Alcohols are often obtained via catalytic hydroformylation or hydrogenation (alternatively called the 'oxo-process') from corresponding olefins reacted with gas containing carbon monoxide, hydrogen and carbon dioxide (examples of processes are described in U.S. Pat. Nos. 3,278,612 A and 4,207,263).

The carboxylic acid reactant may be a monocarboxylic acid or a dicarboxylic acid. When the carboxylic acid is a monocarboxylic acid, the amide is preferably a monoamide. When the carboxylic acid is a dicarboxylic acid, the amide is preferably a diamide.

When the carboxylic acid is a monocarboxylic acid, the resulting amide is a compound of Formula (Ia).

In this embodiment, the monocarboxylic acid may be branched or linear and may be saturated or unsaturated. The monocarboxylic acid preferably comprises up to 36 carbon atoms, preferably up to 22 carbon atoms and most preferably up to 18 carbon atoms. The monocarboxylic acid preferably comprises at least 4 carbon atoms, preferably at least 6 carbon atoms and most preferably at least 8 carbon atoms. Examples of suitable branched and linear monocarboxylic acids include, but are not limited to linear acids such as hexanoic acid, heptanoic acid, caprylic acid, nonanoic acid, capric acid, lauric acid, myristic acid, palmitic acid, heptadecanoic acid, stearic acid arachidic acid and behenic acid; iso-acids such as isostearic acid, isomyristic acid, isopalmitic acid, isoarachidic acid and isobehenic acid; neo-acids such as neocapric acid; anti-iso acids; polybranched acids such as 2-ethyl hexanoic acid and 3,5,5'-trimethylhexanoic acid; unsaturated acids such as oleic acid, iso-oleic acid, linoleic acid, linolenic acid, erucic acid and palmitoleic acid.

Preferably, the monocarboxylic acid is saturated. Preferably, the monocarboxylic acid is selected from the group comprising 2-ethyl hexanoic acid, 3,5,5'-trimethylhexanoic acid, caprylic/capric acid, lauric acid, stearic acid and isostearic acid. Preferably, the monocarboxylic acid is branched. Most preferably, the monocarboxylic acid is 2-ethyl hexanoic acid, 3,5,5'-trimethylhexanoic acid or isostearic acid.

When the carboxylic acid is a dicarboxylic acid, the resulting amide is a compound of Formula (Ib).

In one embodiment, the dicarboxylic acid is a linear or branched, saturated or unsaturated divalent $C_2$ to $C_{14}$ acid. In this embodiment, the dicarboxylic acid preferably comprises up to 12 carbon atoms and most preferably up to 10 carbon atoms. In this embodiment, the dicarboxylic acid may be selected from the group comprising oxalic acid, malonic acid, succinic acid, maleic acid, glutaric acid, adipic acid, pimelic acid, suberic acid, azelaic acid, sebacic acid, undecanoic acid and dodecanoic acid, preferably adipic acid, suberic acid and sebacic acid, more preferably adipic acid.

Preferably, the dicarboxylic acid is linear. Preferably, the dicarboxylic acid is saturated.

The dicarboxylic acid may be a dimer acid. In this embodiment, the dimer acid preferably comprises from 24 to 52 carbon atoms, preferably from 28 to 48 carbon atoms, more preferably from 32 to 46 carbon atoms and most preferably from 36 to 44 carbon atoms. Preferably the dimer acid is a C36 dimer acid.

The term "dimer fatty acid" is well known in the art and refers to the dimerisation product of mono- or polyunsaturated fatty acids and/or esters thereof. Preferred dimer acids are dimers of $C_{10}$ to $C_{30}$, more preferably $C_{12}$ to $C_{24}$, particularly $C_{14}$ to $C_{22}$, and especially $C_{18}$ alkyl chains. Suitable dimer fatty acids include the dimerisation products of oleic acid, linoleic acid, linolenic acid, palmitoleic acid, and elaidic acid. The dimerisation products of the unsaturated fatty acid mixtures obtained in the hydrolysis of natural fats and oils, e.g. sunflower oil, soybean oil, olive oil, rapeseed oil, cottonseed oil and tall oil, may also be used. Hydrogenated, for example by using a nickel catalyst, dimer fatty acids may also be employed.

In addition to the dimer fatty acids, dimerisation usually results in varying amounts of oligomeric fatty acids (so-called "trimer") and residues of monomeric fatty acids (so-called "monomer"), or esters thereof, being present. The amount of monomer can, for example, be reduced by distillation. Particularly preferred dimer fatty acids have a dicarboxylic (or dimer) content of greater than 70%, more preferably greater than 85%, and particularly greater than 94% by weight.

The carboxylic acid is preferably a monocarboxylic acid.

Mixtures of said carboxylic acids could be used as the starting material for the production of the amide. Where mixtures of carboxylic acids are employed, preferably the mixtures are mixtures of two or more monocarboxylic acids or mixtures of two or more dicarboxylic acids, more preferably mixtures of two monocarboxylic acids. Said mixtures of acids may be commercially available as mixtures, for example capric and caprylic acids which are commercially available as C-810L™ from Proctor & Gamble.

Carboxylic acids suitable for use herein can be obtained from natural sources such as, for example plant or animal esters. For example, the acids may be obtained from palm oil, rape seed oil, palm kernel oil, coconut oil, babassu oil, soybean oil, castor oil, sunflower oil, olive oil, linseed oil, cottonseed oil, safflower oil, tallow, whale or fish oils, grease, lard and mixtures thereof. The carboxylic acids can also be synthetically prepared. Relatively pure unsaturated carboxylic acids such as oleic acid, linoleic acid, linolenic acid, palmitoleic acid, and elaidic acid may be isolated, or relatively crude unsaturated carboxylic acid mixtures employed. Resin acids, such as those present in tall oil, may also be used.

As will be appreciated, the acids and amines used to make said amides in the present invention will be from commercial sources and may not necessarily comprise 100 wt % of the acid or alcohol component under consideration. Such commercial products usually comprise a major proportion of the primary product together with other isomers and/or additional products of shorter or longer chain length. This may lead to variations in properties of the amides which are reaction products of the amidation reactions.

Preferably, the amide has a kinematic viscosity at 40° C., measured according to the method set out in ASTM D445, of at least 5 cSt, preferably at least 10 cSt, more preferably at least 15 cSt. Preferably, the amide has a kinematic viscosity at 40° C., measured according to the method set out in ASTM D445, of up to 320 cSt, preferably up to 280 cSt, more preferably up to 250 cSt.

Preferably, the amide has a kinematic viscosity at 100° C., measured according to the method set out in ASTM D445, of at least 1 cSt, preferably at least 2 cSt, more preferably at least 2.5 cSt. Preferably, the amide has a kinematic viscosity at 100° C., measured according to the method set out in ASTM D445, of up to 50 cSt, preferably up to 45 cSt, more preferably up to 40 cSt.

Preferably, the amide has a pour point, measured according to the method set out in ASTM D97, of not more than about −20° C., more particularly of not more than −25° C. and especially not more than −30° C.

Preferably, the neat amide has a hydrolytic stability measured according to the method set out in ASTM D943 of at least 40 hours, preferably at least 45 hours and most preferably at least 50 hours.

The lubricant and grease compositions may comprise one or more amide components. Preferably, the lubricant and grease compositions comprise only one amide component.

Where the lubricant and grease compositions comprise two or more amides, each amide may be selected with different properties. Preferably, the properties of each amide are within the values of such properties as described above. However, alternatively, one or more of the properties of at least one amide may be outside the values of such properties as described above provided that the properties of the mixture of amides are within the values of such properties as described above.

In an exemplary embodiment, the base oil further comprises an oil that is different from the amides of Formula (Ia) and (Ib), such as an oil selected from a poly-α-olefin (PAO) oil, a silicone oil, a synthetic hydrocarbon oil, an ester-based synthetic oil, an ether-based synthetic oil, vegetable oil and a glycol-based synthetic oil. The relative amounts of the different oil and the amides of Formula (Ia) and (Ib) are described herein.

Preferably, the lubricant and grease compositions are non-aqueous. However, it will be appreciated that components of the lubricant and grease compositions may contain small amounts of residual water (moisture) which may therefore be present in the lubricant and grease compositions. The lubricant and grease compositions may comprise less than 5% water by weight based on the total weight of the composition. More preferably, the lubricant and grease compositions are substantially water-free, i.e. contain less than 2%, less than 1%, or preferably less that 0.5% water by weight based on the total weight of the composition.

Preferably the lubricant and grease compositions are substantially anhydrous.

The lubricant and grease compositions may comprise at least 0.1 wt % of said at least one additive, preferably at least 0.5 wt %, more preferably at least 1 wt %, and desirably at least 2 wt % based on the total weight of the composition. The lubricant and grease compositions may comprise up to 40 wt % of said at least one additive, preferably up to 30 wt %, more preferably up to 20 wt % and desirably up to 10 wt % based on the total weight of the composition.

The lubricant composition may be an engine oil, hydraulic oil or fluid, gear oil, chain oil, metal working fluid or refrigerant oil. To adapt the lubricant and grease compositions to their intended use, the lubricant and grease compositions may comprise one or more of the following additive types.

1. Dispersants: for example, alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

2. Anti-oxidants: Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants include phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-me-thyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butyl-phenol, 2,6-di-tert-1-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert-~butylbenzyl)-sulfide, and bis(3,5-di-tert-butyl-4-hydroxy-benzyl). Other types of oxidation inhibitors include alkylated diphenylamines (e.g., IRGANOX® L-57 from Ciba-Geigy), metal dithiocarbamate (e.g., zinc dithiocarbamate), and methylenebis(dibutyldithiocarbamate).

3. Antiwear agents: As their name implies, these agents reduce wear of moving metallic parts. Examples of such agents include zinc dialkyldithiophosphate (primary alkyl, secondary alkyl, and aryl type), phosphates, phosphites, carbamates, esters, sulfur containing compounds, and molybdenum complexes.

4. Emulsifiers: for example, linear alcohol ethoxylates.

5. Demulsifiers: for example, addition products of alkylphenol and ethylene oxide, polyoxyethylene alkyl ethers, and polyoxyethylene sorbitan esters.

6. Extreme pressure agents (EP agents): for example, sulfurized oils, diphenyl sulfide, methyl trichlorostearate, chlorinated naphthalene, fluoroalkylpolysiloxane, and lead naphthenate. A preferred EP agent is zinc dialkyl dithiophosphate (ZnDTP or ZDDP), e.g. as one of the co-additive components for an antiwear hydraulic fluid composition.

6a. Solid EP and antiwear additives such as graphite and milled graphite, molybdenum disulfide, tungsten disulfide, titanium dioxide, graphene, oxidized graphene, and mineral clays.

7. Multifunctional additives: for example, sulfurized oxymolybdenum dithiocarbamate, sulfurized oxymolybdenum organo phosphorodithioate, oxymolybdenum monoglycehde, oxymolybdenum diethylate amide, amine-molybdenum complex compound, and sulfur-containing molybdenum complex compound.

8. Viscosity index improvers: for example, polymethacrylate polymers, ethylene-propylene copolymers, styrene-isoprene copolymers, hydrogenated styrene-isoprene copolymers, polyisobutylene, and dispersant type viscosity index improvers.

9. Pour point depressants: for example, polymethacrylate polymers.

10. Foam inhibitors: for example, alkyl methacrylate polymers and dimethyl silicone polymers.

11. Friction modifying agents, preferably friction reducing agents: for example, esters, partial esters, phosphonates, organomolybdenum-based compounds, fatty acids, higher alcohols, fatty acid esters, sulfur containing esters, phosphate esters, acid phosphoric acid esters, and amine salts of phosphoric acid esters.

The additive or additives may be available in the form of a commercially available additive pack. Such additive packs vary in composition depending on the required use of the additive pack. A skilled person may select a suitable commercially available additive pack for each of: an engine oil, a gear oil, a hydraulic fluid and a metal working fluid. An example of a suitable additive pack for an engine oil is HITEC® 11100 (ex. Afton Chemical Corporation, US) which is recommended to be used at about 10 wt % of the lubricant composition. An example of a suitable additive pack for a gear oil is ADDITIN® RC 9451 (ex. Rhein Chemie Rheinau GmbH, Germany) which is recommended to be used at between 1.5 to 3.5 wt % of the lubricant composition. An example of a suitable additive pack for a hydraulic oil or fluid is ADDITIN® RC 9207 (ex. Rhein Chemie Rheinau GmbH, Germany) which is recommended to be used at about 0.85 wt % of the lubricant composition. An example of a suitable additive pack for a metal working fluid is ADDITIN® RC 9410 (ex. Rhein Chemie Rheinau GmbH, Germany) which is recommended to be used at between 2 to 7 wt % of the lubricant composition. An example of a suitable additive pack for a grease is Hitec 343G (ex. Afton Chemical, USA) which is recommended for use at between 0.5 to 5.0 wt % of the grease composition.

The lubricant composition according to the present invention may comprise said amide and said at least one additive along with a further base oil, or may consist essentially of said amide and said additive(s). Similarly, the grease composition may comprise said amide, said thickener and said at last one additive along with a further base oil, or may consist essentially of said amide, said thickener and said additive(s).

When the lubricant composition does not consist essentially of said amide and said additive(s), or when the grease composition does not consist essentially of said amide, said thickener and said additive(s), the balance of the lubricant and grease compositions comprise a further base oil which is a lubricant component selected from API Groups I, II, III, III+ (including gas-to-lubricants), IV, IV+ and V lubricants and mixtures of two or more thereof.

Examples of suitable Group III lubricants include mineral oils. Examples of suitable Group IV lubricants included poly-α-olefins derived from $C_8$ to $C_{12}$ α-olefins and having kinematic viscosities in the range 3.6 cSt to 8 cSt at 100° C. Examples of Group V lubricants include alkyl naphthalenes, alkyl benzenes and esters, for example esters derived from monohydric alcohols and/or polyols and monocarboxylic acids or polycarboxylic acids. Examples of alkyl naphthalenes include SYNESSTIC™ 5 and SYNESSTIC™ 12 alkyl naphthalenes available from Mobil. Examples of esters are PRIOLUBE™ 1976 a monoester and PRIOLUBE™ 3970 a TMP $nC_8/nC_{10}$ polyol ester. GTL base stocks are made by conversion of natural gas (i.e., methane and higher alkanes) to synthesis gas (carbon monoxide and hydrogen) and then via oligomerisation (e.g., the Fischer-Tropsch process) to higher molecular weight molecules that are hydrocracked to produce iso-paraffins in the required lubricant boiling/viscosity range. GTL base stocks are only just being commercialised and consequently there is little or no data relating to them that is freely available. As far as it is known, such GTL base stocks will have viscosity grades similar to poly-α-olefins.

Preferably, the weight ratio of amide to said further base oil will be between 100:0 to 1:99, preferably between 99:1 to 1:99, more preferably between 60:40 and 2:98, more particularly between 40:60 and 3:97, and especially between 20:80 to 5:95.

Preferably, the lubricant composition comprises at least 1 wt % amide, preferably at least 2 wt %, more preferably at least 5 wt % based on the total weight of the composition. Preferably, the lubricant composition comprises up to 99.9 wt % amide, preferably up to 99 wt %, preferably up to 90 wt %, preferably up to 80 wt %, more preferably up to 50 wt %, more particularly up to 30 wt %, most preferably up to 20 wt % and desirably up to 10 wt % based on the total weight of the composition.

As previously described, the lubricant and grease compositions may comprise at least 0.1 wt % of said at least one additive, preferably at least 0.5 wt %, more preferably at least 1 wt %, and desirably at least 2 wt % based on the total weight of the composition. The lubricant composition may comprise up to 40 wt % of said at least one additive, preferably up to 30 wt %, more preferably up to 20 wt % and desirably up to 10 wt % based on the total weight of the composition.

Preferably, the lubricant composition comprises at least 1 wt % of a further base oil, preferably at least 20 wt %, more preferably at least 40 wt %, and most preferably at least 60 wt % based on the total weight of the composition. Preferably, the lubricant composition comprises up to 98.9 wt % of a further base oil, preferably up to 98 wt %, more particularly up to 95 wt %, and most preferably up to 90 wt % based on the total weight of the composition.

In one embodiment, the lubricant composition of the present invention is used as an engine oil, preferably an automotive or marine engine oil, more preferably an automotive engine oil. When the lubricant composition is an engine oil, additives are preferably present at a concentration in the range from 0.1 to 30 wt % based on the total weight of the engine oil. For an automotive engine oil the term further base oil includes both gasoline and diesel (including heavy duty diesel (HDDEO)) engine oils. The further base oil may be chosen from any of the Group I to Group V base oils (which includes Group III+ gas to liquid) or a mixture thereof. Preferably, the further base oil has one of Group II, Group III or a Group IV base oil as its major component, especially Group III. By major component, is meant at least 50%, preferably at least 65%, more preferably at least 75%, especially at least 85% by weight of the further base oil.

The further base oil may also comprise as a minor component, by which is meant preferably less than 30%, more preferably less than 20%, especially less than 10% by weight of co-base oil of any or a mixture of Group III+, IV and/or Group V base oils which have not been used as the major component in the further base oil. Examples of such Group V base oils include alkyl naphthalenes, alkyl aromatics, vegetable oils, esters, for example monoesters, diesters and polyol esters, polycarbonates, silicone oils and polyalkylene glycols. More than one type of Group V base stock may be present. Preferred Group V base stocks are esters, particularly polyol esters.

For an engine oil, the base stock may range from SAE viscosity grade 0W to 15W. The viscosity index is preferably at least 90 and more preferably at least 105. The base stock preferably has a viscosity at 100° C. of 3 to 10 $mm^2/s$, more preferably 4 to 8 $mm^2/s$. The Noack volatility, measured according to ASTM D-5800 is preferably less than 20%, more preferably less than 15%.

Preferably, the engine oil is a low viscosity engine oil, preferably the engine oil has an SAE class rating of less than 5W, more especially an SAE class rating of 0W. Low viscosity engine oils are increasingly desirable and a significant proportion of current engine lubricant base oils are not suitable for this purpose. Some disadvantages of such lubricants include the inherent limitation imposed by the viscosity indices of the base oils (which impacts film thickness); and the inability to reduce viscosity without increasing volatility (i.e., increasing the Noack evaporation loss of the lubricant). Additionally, very low viscosity esters can also have high polarity which can lead to seal compatibility issues and potential wear issues due to competition with antiwear agents such as ZDDP when the esters are used at high dose rates, e.g., >15 wt %. For example, di-isooctyl adipate has an NPI of 41. In addition, low viscosity lubricants, which have been optimised to give low volatilities, can also suffer from either low viscosity indices (<125), poor low temperature flow properties or shorter drain intervals resulting from poor oxidative stability (from the use of components in which gem dimethyl branching is present). The amides of the present invention provide a suitable, and in many cases, advantageous alternative to existing engine lubricant base oils for low viscosity systems since they provide good viscosity whilst at the same time providing good hydrolytic, thermal and oxidative stability.

For engine oils, a friction reducing additive may be present at levels of at least 0.2 wt %, preferably at least 0.3 wt %, more preferably at least 0.5 wt % based on the total weight of the engine oil. The friction reducing additive may be present at levels of up to 5 wt %, preferably up to 3 wt %, more preferably up to 2 wt % based on the total weight of the engine oil.

The automotive engine oil may also comprise other types of additives of known functionality at levels between 0.1 to 30 wt %, more preferably between 0.5 to 20 wt %, yet more preferably between 1 to 10 wt % based on the total weight of the engine oil. These further additives can include detergents, dispersants, oxidation inhibitors, corrosion inhibitors, rust inhibitors, anti-wear additives, foam depressants, pour point depressants, viscosity index improvers and mixtures thereof. Viscosity index improvers may include polyisobutenes, polymethacrylate acid esters, polyacrylate acid esters, diene polymers, polyalkyl styrenes, alkenyl aryl conjugated diene copolymers and polyolefins. Foam depressants may include silicones and organic polymers. Pour point depressants may include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents may include carboxylic dispersants, amine dispersants, Mannich dispersants and polymeric dispersants. Antiwear additives may include ZDDP, ashless and ash containing organic phosphorous and organo-sulphur compounds, boron compounds, and organo-molybdenum compounds. Ash-containing dispersants may include neutral and basic alkaline earth metal salts of an acidic organic compound. Oxidation inhibitors may include hindered phenols and alkyl diphenylamines. Additives may include more than one functionality in a single additive.

The lubricant composition of the present invention may be used as a gear oil. The gear oil may be an industrial, automotive and/or marine gear oil. When the lubricant composition is a gear oil, additives are preferably present in the range between 0.1 to 30 wt % based on the total weight of the gear oil.

The gear oil may have a kinematic viscosity according to an ISO grade. An ISO grade specifies the mid-point kinematic viscosity of a sample at 40° C. in cSt ($mm^2/s$). For example, ISO 100 has a viscosity of 100±10 cSt and ISO 1000 has a viscosity of 1000±100 cSt. The gear oil preferably has a viscosity in the range from ISO 10 to ISO 1500, more preferably ISO 68 to ISO 680.

Gear oils according to the invention preferably have good low temperature properties. For example, the viscosity of such formulations at −35° C. is less than 120,000 centapoise (cP), more preferably less than 100,000 cP, especially less than 90,000 cP.

Industrial gear oils include those suitable for use in gear boxes with spur, helical, bevel, hypoid, planetary and worm gears. Suitable applications include use in mining; mills such as paper, textile and sugar mills; steel production and in wind turbines. One preferred application is in wind turbines where the gear boxes typically have planetary gears.

In a wind turbine, the gear-box is typically placed between the rotor of a wind turbine blade assembly and the rotor of a generator. The gear-box may connect a low-speed shaft turned by the wind turbine blade(s) rotor at about 10 to 30 rotations per minute (rpm), to one or more high speed shafts that drive the generator at about 1000 to 2000 rpm, the rotational speed required by most generators to produce electricity. The high torque exerted in the gear-box can generate huge stress on the gears and bearings in the wind turbine. A gear oil of the present invention may enhance the fatigue life of the gear-box of a wind turbines by reducing the friction between the gears.

Lubricants in wind turbines gearboxes are often subjected to prolonged periods of use between maintenance, i.e. long service intervals. Therefore a long lasting lubricant composition with high stability may be required, so as to provide suitable performance over lengthy durations of time.

Automotive gear oils include those suitable for use in manual transmissions, transfer cases and differentials which all typically use a hypoid gear. By transfer case we mean a part of a four wheel drive system found in four wheel drive and all wheel drive systems. It is connected to the transmission and also to the front and rear axles by means of driveshafts.

It is also referred to in the literature as a transfer gearcase, transfer gearbox, transfer box or jockey box.

Marine thruster gearboxes have specific gear oils that include a higher proportion of additives, e.g. dispersants, anticorrosives, to deal with corrosion and water entrainment compared to industrial and automotive gear oils. There are also outboard gear oils used for the propeller unit which may be more relevant for smaller vessels.

A gear oil according to the invention may comprise one or more of the additives described herein. The gear oil preferably comprises one or more additive(s) which may include at least one species of extreme-pressure agent selected from the group consisting of sulfur-based additives and phosphorus-based additives, or at least one species of the extreme-pressure agents and at least one species of additive selected from the group consisting of solubilizing agent, friction modifying agent, ashless dispersant, pour point depressant, antifoaming agent, antioxidant, rust inhibitor, and corrosion inhibitor.

Additives may be present in the gear oils of known functionality at levels between 0.01 to 30 wt %, more preferably between 0.01 to 20 wt %, and more especially between 0.01 to 10 wt % based on the total weight of the gear oil. These can include detergents, extreme pressure/antiwear additives, dispersants, corrosion inhibitors, rust inhibitors, friction modifiers, foam depressants, pour point depressants, and mixtures thereof. Extreme pressure/antiwear additives include ZDDP, tricresyl phosphate, amine phosphates. Corrosion inhibitors include sarcosine derivatives, for example CRODASINIC™ O available from Croda Europe Ltd. Foam depressants include silicones and organic polymers. Pour point depressants include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents include carboxylic dispersants, amine dispersants, Mannich dispersants and polymeric dispersants. Friction modifiers include amines and partial fatty acid esters of polyhydric alcohols. Ash-containing dispersants include neutral and basic alkaline earth metal salts of an acidic organic compound. Additives may have more than one functionality in a single material.

The gear oil may further comprise an antioxidant preferably in the range 0.2 to 2 wt %, more preferably 0.4 to 1 wt % by weight based on the total weight of the gear oil. Antioxidants include hindered phenols, alkyl diphenylamines and derivatives and phenyl alpha naphthylamines and derivatives thereof. Gear oil compositions with the presence of the antioxidant preferably exhibit a percentage viscosity loss, measured using a modified version of CEC L-40-A-93, over a 100 hour period of less than 20%, more preferably less than 15% and especially less than 10%.

The gear oil preferably comprises at least 0.1 wt %, more preferably at least 0.5 wt %, particularly at least 1 wt %, and especially at least 1.5 wt % of additive(s) (additive pack) based upon the total weight of the gear oil. The gear oil preferably comprises up to 15 wt %, more preferably up to 10 wt %, particularly up to 4 wt %, and especially up to 2.5 wt % of further additive(s) (additive pack) based upon the total weight of the gear oil.

Suitable commercially available additive packs for industrial gear oils include HITEC® 307 (for wind turbines), 315, 317 and 350 (ex Afton); IRGALUBE® ML 605 A (ex BASF); LUBRIZOL® IG93MA, 506, 5064 and 5091 (ex Lubrizol); VANLUBE® 0902 (ex Vanderbilt); ADDITIN® RC 9330, ADDITIN® RC 9410 and ADDITIN® RC 9451 (ex Rhein Chemie); NA-LUBE BL-1208 (ex King Industries).

The lubricant composition of the present invention may be used as a hydraulic oil or fluid. When the lubricant composition is a hydraulic oil or fluid, additives are suitably present in the range from 0.1 to 30 wt % based on the total weight of the hydraulic fluid.

The hydraulic fluid may have a viscosity from ISO 10 to ISO 100, preferably from ISO 32 to ISO 68.

Hydraulic fluids find use wherever there is a need to transfer pressure from one point to another in a system. Some of the many commercial applications where hydraulic fluids are utilized are in aircraft, braking systems, compressors, machine tools, presses, draw benches, jacks, elevators, die-castings, plastic moldings, welding, coal-mining, tube reducing machines, paper-machine press rolls, calendar stacks, metal working operations, fork lifts, and automobiles.

A hydraulic oil or fluid according to the invention may comprise one or more of the additives described herein.

The lubricant composition of the present invention may be used as a metalworking fluid. When the lubricant composition is a metal working fluid, additives are preferably present in the range between 1 to 40 wt % based on the total weight of the metal working fluid.

The metal working fluid may have a viscosity of at least ISO 10, preferably at least ISO 100.

Metalworking operations include for example, rolling, forging, hot-pressing, blanking, bending, stamping, drawing, cutting, punching, spinning and the like and generally employ a lubricant to facilitate the operation. Metalworking fluids generally improve these operations in that they can provide films of controlled friction or slip between interacting metal surfaces and thereby reduce the overall power required for the operations, and prevent sticking and decrease wear of dies, cutting bits and the like. Sometimes the lubricant is expected to help transfer heat away from a particular metalworking contact point.

Metal working fluids often comprise a carrier fluid and one or more additives. The carrier fluid imparts some general lubricity to the metal surface and carries/delivers the specialty additives to the metal surfaces. Additionally, the metal working fluid may provide a residual film on the metal part thereby adding a desired property to the metal being processed. The additives can impart a variety of properties including friction reduction beyond hydrodynamic film lubrication, metal corrosion protection, extreme pressure or anti-wear effects. The carrier fluid may be a further base oil as described herein.

Carrier fluids include various petroleum distillates including American Petroleum Institute Group I to V base stocks. The additives can exist within the carrier fluid in a variety of forms including as dissolved, dispersed in, and partially soluble materials. Some of the metal working fluid may be lost to or deposited on the metal surface during the working process; or may be lost to the environment as spillage, sprays, etc., and may be recyclable if the carrier fluid and additives have not degraded significantly during use. Due to entry of a percentage of the metal working fluid into process goods and industrial process streams, it is desirable if the components to the metal working fluid are eventually biodegradable and pose little risk of bioaccumulation to the environment.

The metalworking fluid may comprise up to 90 wt % in total of amide plus further base oil, more preferably up to 80 wt % based on the total weight of the metal working fluid.

A metalworking fluid according to the invention may comprise one or more of the additives described herein. The metalworking fluid may comprise at least 10 wt % of additives based on the total weight of the metal working fluid.

The lubricant composition of the present invention may be used as a refrigerant oil. When the lubricant composition is a refrigerant oil, one or more additives are preferably present in the range between 1 to 20 wt % based on the total weight of the refrigerant oil.

The refrigerant oil may have a viscosity of from ISO 10 to ISO 500, preferably ISO 20 to ISO 250.

Refrigerant oils are used in compressor systems where lubrication is required, in particular since heat generation in moving parts due to friction must be minimised. A refrigerant oil according to the present invention may comprise one or more of the additives described herein. A refrigerant oil may also comprise a further base oil of the type described above. Preferably, when present, the further base oil is a polyol ester base oil (POE oil).

The grease compositions of the present invention are suitable for any number of diverse applications where a grease is desired or required (e.g. bearings, gearboxes, actuators, electric motors, chains and rail-slide systems), especially where rotational movement is involved. The compositions are particularly well suited for use outside (e.g., wind turbines, automotive and rail) and in areas involving food/water contact (e.g., food manufacturing (e.g., bakery), sea freight, conveyor belts (especially for food or crop). A major advantage of the grease compositions of the invention is their unexpected hydrolytic stability (likely due to the liquid amide component(s)) so they can be employed in wet areas, where the presence of water would ordinarily result in degradation of a grease. High end electronics provide another area of application of the grease compositions where lubrication of small parts often has a "fill for life" requirement for which the hydrolytically and oxidatively stable grease compositions are ideally suited.

Any of the above features may be taken in any combination and with any aspect of the invention.

EXAMPLES

The present invention will now be described further, for illustrative purposes only, in the following examples. All parts and percentages are given by weight, based on the total weight of the material or composition as appropriate, unless otherwise stated.

Synthesis Examples

Example 1

To a 1 liter round bottom flask equipped with Dean-Stark apparatus connected with water condenser was charged isostearic acid (284 g, 1 mol), (Di-2-ethylhexyl)amine (295 g, 1.05 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess (di-2-ethylhexyl)amine at 35 mmHg/240° C. until base number was below 2. The reaction mixture was cooled at 110° C., filtered through a filter paper under full vacuum to give the product as clear liquid, straw color. The sample was taken for QC analysis which generated the results below.

$^{1}$H NMR (400 MHz, $CDCl_3$) δ 3.40-3.20 (2H, m), 3.20-3.05 (2H, m), 2.40-2.20 (2H, m), 1.90-1.50 (4H, m), 1.50-1.10 (41H, m), 1.10-0.60 (18H, m)

$^{13}$C NMR (100 MHz, $CDCl_3$) δ 173.4, 51.3, 48.7, 38.7, 37.0, 36.9, 33.4, 32.7, 32.4, 32.2, 30.0-29.0 multiple peaks, 29.0-28.3 multiple peaks, 27.2-26.5 multiple peaks, 25.6, 23.9, 23.8, 23.0, 22.9, 22.6, 19.6 multiple peaks, 14.5-14.5 multiple peaks, 11.0-10.2 multiple peaks.

Example 2

To a 1 liter round bottom flask equipped with Dean-Stark apparatus connected with water condenser was charged 2-Ethylhexanoic acid (184 g, 1.2 mol), (Di-2-ethylhexyl) amine (281 g, 1 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess 2-ethylhexanoic acid at 35 mmHg/240° C. until AV was below 1. The reaction mixture was cooled at 110° C., filtered through a filter paper under full vacuum to give the product as liquid amide. The sample was taken for QC analysis which generated the results below.

$^{1}$H NMR (400 MHz, $CDCl_3$) δ 3.40-3.10 (4H, m), 2.60-2.40 (1H, m), 1.85-1.55 (4H, m), 1.55-1.40 (2H, m), 1.40-1.15 (20H, m), 1.05-0.75 (18H, m)

$^{13}$C NMR (100 MHz, $CDCl_3$) δ 176.2, 51.9, 51.8, 50.2-49.6 multiple peaks, 42.8, 39.3, 39.2, 37.2, 32.3, 32.2, 30.5, 29.8-29.7 multiple peaks, 28.0-27.4 multiple peaks, 25.7, 23.6, 23.5, 22.9, 22.8, 13.9, 13.8, 12.0, 10.7, 10.4.

Example 3

To a 1 liter round bottom flask equipped with Dean-Stark apparatus connected with water condenser was charged Adipic Acid (146 g, 1.0 mol), (Di-2-ethylhexyl)amine (600 g, 2.1 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess Di-(2-ethylhexyl)amine at 35 mmHg/240° C. until base number was below 0.5. The reaction mixture was cooled at 110° C., filtered through a filter paper under full vacuum to give the product as liquid amide. The sample was taken for QC analysis which generated the results below.

$^{1}$H NMR (400 MHz, $CDCl_3$) δ 3.40-3.20 (4H, m), 3.20-3.10 (4H, m), 2.45-2.25 (4H, m), 1.80-1.65 (6H, m), 1.65-1.50 (2H, m), 1.45-1.10 (32H, m), 1.05-0.75 (24H, m)

$^{13}$C NMR (100 MHz, $CDCl_3$) δ 172.6, 51.1, 49.4, 38.2, 36.7, 30.2, 30.1, 28.2, 28.1, 25.0, 23.6, 23.5, 23.4, 22.7, 22.6, 13.6, 10.5, 10.2

Example 4

To a 1 liter round bottom flask equipped with Dean-Stark apparatus connected with water condenser was charged 3,5,5'-trimethylhexanoic acid (284 g, 1.9 mol), (Di-2-ethylhexyl)amine (295 g, 1.05 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess Di-(2-ethylhexyl)amine at 35 mmHg/240° C. until base number was below 2. The reaction mixture was cooled at 110° C., filtered through a filter paper under full vacuum to give the product as liquid amide. The sample was taken for QC analysis which generated the results below.

$^{1}$H NMR (400 MHz, $CDCl_3$) δ 3.45-3.25 (2H, m), 3.25-3.10 (2H, m), 2.40-2.20 (3H, m), 1.56-1.53 (1H, m), 1.53-1.51 (1H, m), 1.50-1.15 (18H, m), 1.10-0.70 (24H, m)

$^{13}$C NMR (100 MHz, $CDCl_3$) δ 172.5, 51.5, 51.0, 48.9, 43.0, 38.5, 36.9, 31.0, 30.7-30.2 multiple peaks, 30.1, 30.0, 28.6, 28.5, 27.0, 23.7, 23.6, 23.5, 22.9, 22.8, 22.7, 22.4, 14.0, 14.9, 10.8, 10.7, 10.5

Example 5

To a 1 liter round bottom flask equipped with Dean-Stark apparatus connected with water condenser was charged $C_8$-10 fatty acid (C-810L supplied by P&G) (200 g, 1.31 mol), (Di-2-ethylhexyl)amine (281 g, 1 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess acid at 35 mmHg/240 C° until AV was below 0.5. The reaction mixture was cooled at 110° C., filtered through a filter paper under full vacuum to give the product as liquid amide.

Example 6

To a 1 liter round bottom flask equipped with Dean-Stark apparatus connected with water condenser was charged Lauric Acid (210 g, 1.05 mol), (Di-2-ethylhexyl)amine (337 g, 1.20 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess Di-(2-ethylhexyl)amine at 35 mmHg/240° C. until base number was below 2. The reaction mixture was cooled at 110° C., filtered through a filter paper under full vacuum to give the product as liquid amide.

Example 6A

To a 1 liter round bottom flask equipped with Dean-Stark apparatus connected with water condenser was charged pre-melted coconut fatty acid (250 g with major fatty acid components including C12/lauric at about 50 wt % and C14/myristic at about 18 wt %), di-(2-ethylhexyl)-amine (358 g), and sodium hypophosphite (3 g). The reaction mixture was heated from room temperature to 240° C. over 2 hours. The water was generated from the reaction and collected/separated in the Dean-Stark. Organics were refluxed from Dean-Stark to the flask. Reaction was held at 240° C. until the acid value was below 0.5. Vacuum was gradually applied at 100 mmHg to strip excess Di-(2-ethylhexyl)amine until the alkali value was below 0.5. The reaction mixture was cooled at 80° C., filtered through a filter paper under full vacuum to give the product as liquid amide.

Example 7

To a 1 liter round bottom flask equipped with Dean-Stark apparatus connected with water condenser was charged 2-Ethylhexanoic acid (288 g, 2 mol), diisopropylamine (240 g, 2.4 mol), and sodium hypophosphite (3 g, 0.028 mol). The reaction mixture was heated from room temperature to 220° C. over 180 minutes. The water was generated from the reaction and collected/separated in the Dean-Stark. Organics were refluxed from Dean-Stark to the flask. Reaction was held at 220° C. until the acid value was below 1.0. The vacuum was gradually applied at 250-200 mmHg for 1 hour, then followed by stripping of excess amine at 35 mmHg/240° C. until base number was below 2. The reaction mixture was cooled at 110° C., filtered through a filter paper under full vacuum to give the product as liquid amide. The sample was taken for QC analysis which generated the results below.

$^1$H NMR (400 MHz, $CDCl_3$) 4.50-4.20 (1H, m), 3.55-3.35 (1H, m), 2.6-2.45 (1H, m), 1.75-1.16 (2H, m), 1.5-1.2 (6H, m), 1.47 (6H, d, J=6.78 Hz), 1.21 (6H, d, J=6.78 Hz), 0.95-0.80 (6H, m)

$^{13}$C NMR (100 MHz, $CDCl_3$) 174.3, 47.7, 45.8, 43.4, 32.6, 29.5, 25.9, 22.6, 20.6, 20.4, 13.6, 11.7

Example 8

To a 1 liter round bottom flask equipped with Dean-Stark apparatus connected with water condenser was charged Isostearic acid (288 g, 1 mol), diisopropyl amine (280 g, 2.17 mol) and sodium hypophosphite (3 g, 0.028 mol). The reaction mixture was heated from room temperature to 220° C. over 40 minutes. The water was generated from the reaction and collected/separated in the Dean-Stark. Organics were refluxed from Dean-Stark to the flask. Reaction was held at 220° C. until the acid value was below 1.0. The vacuum was gradually applied at 250-200 mmHg for 1 hour, then followed by stripping of excess amine at 35 mmHg/240° C. until base number was below 2. The reaction mixture was cooled at 110° C., filtered through a filter paper under full vacuum to give the product as liquid amide.

Example 9

To a 1 liter round bottom flask equipped with Dean-Stark apparatus connected with water condenser was charged stearic acid (249 g, 0.876 mol), (Di-2-ethylhexyl)amine (259 g, 0.92 mol) and sodium hypophosphite (3 g, 0.028 mol). The reaction mixture was heated from room temperature to 240° C. over 40 minutes. The water was generated from the reaction and collected/separated in the Dean-Stark. Organics were refluxed from Dean-Stark to the flask. Reaction was held at 240° C. until the acid value was below 1.0. The vacuum was gradually applied at 250-200 mmHg for 1 hour, then followed by stripping of excess Di-(2-ethylhexyl)amine at 35 mmHg/240° C. until base number was below 2. The reaction mixture was cooled at 110° C., filtered through a filter paper under full vacuum to give the product as liquid amide.

Examples 10 to 13

The method set out above for the production of Examples 1 to 9 was followed with the reactants set out in Table 1 below to produce further amides.

TABLE 1

| Example | Amine | Acid |
|---|---|---|
| 10 | Diisobutylamine | 2-ethylhexanoic acid |
| 11 | Ditridecylamine (mixture of isomers) | 2-ethylhexanoic acid |
| 12 | Di-(2-ethylhexyl)amine | C36 dimer acid |
| 13 | Di-(2-ethylhexyl)amine | Sebacic acid |

Properties of Examples 1 to 10

The physical properties of the amides produced in Examples 1 to 10 above were measured according to industry standard methods, and the results are recorded in Table 2 below. The properties of four well-known lubricant base oils have also been included in the table by way of comparison.

TABLE 2

| Example | Kinetic Viscosity @40° C. | Kinetic Viscosity @100° C. | Acid Value (mg KOH/g) | Alkali Number (mg KOH/g) | Pour Point (° C.) |
|---|---|---|---|---|---|
| 1 | 58 | 7.6 | 0.18 | 0.3 | −42 |
| 2 | 26.5 | 3.85 | 0.7 | 0.15 | −49 |
| 3 | 199 | 13.7 | 0.35 | 0.17 | −21 |
| 4 | 30.15 | 4.21 | 3.89 | 0.15 | −39 |
| 5 | 19.6 | 3.6 | 0.21 | 0.36 | −55 |
| 6 | 40.5 | 5.0 | 0.12 | 1.05 | −39 |
| 7 | 7.1 | 2.0 | 0.56 | 0.43 | −55 |
| 8 | 8.7 | 2.5 | 0.4 | 0.67 | −55 |
| 9 | 37.42 | 6.27 | 1.5 | 1.94 | −22 |
| 10 | 7.6 | 2.2 | | | ≤−60 |
| Comparative A: Monoester (PRIOLUBE ™ 1415, ex Croda) | 8.5 | 2.7 | 0.2 | | −27 |
| Comparative B: Diester (PRIOLUBE ™ 1936, ex Croda) | 26 | 5.3 | 0.05 | | −54 |
| Comparative C: Polyolester (PRIOLUBE ™ 3970, ex Croda) | 20 | 4.4 | 0.05 | | −51 |
| Comparative D: Polyolester (PRIOLUBE ™ 1976, ex Croda) | 320 | 23 | 0.5 | | −27 |

Performance Examples

Example 14: Hydrolytic Stability Evaluation

To evaluate hydrolytic stability two ASTM test methods were used: ASTM D2619—Standard Test Method for Hydrolytic Stability of Hydraulic Fluids (Beverage Bottle Method), and ASTM D943 Standard Test Method for Oxidation Characteristics of Inhibited Mineral Oils, which is also reflective of hydrolytic stability of lubricants.

ASTM D943 Standard Test Method for Oxidation Characteristics of Inhibited Mineral Oils was originally used for determination of oxidative stability of mineral oils, however later it was determined that it can also be used to evaluate hydrolytic stability of ester-based lubricants.

Oils exposed to atmospheric oxygen may form sludge and carboxylic acids in a reaction catalyzed by water and metals.

In this example, 300 ml of the test material and 60 ml water were heated together in a test tube with an iron-copper catalyst to 95° C. Oxygen was bubbled through the test material-water mixture at a controlled rate. Periodically, usually at hourly intervals, a small aliquot of oil was removed and the acid number determined. The test was deemed to have finished, and the number of hours from the start of the test recorded, when the acid number reached 2 mg KOH.

In this example, results from the evaluation of hydrolytic stability of the neat amides of Examples 1 and 2 were compared against esters commonly used in lubricant applications. In particular, Comparative A (2-Ethylhexyl Oleate, available from Croda under PRIOLUBE™ 1415), Comparative B (Triisodecyladipate, available from Croda under PRIOLUBE™ 1936), Comparative C (TMP caprate/caprylate, available from Croda under PRIOLUBE™ 3970), and Comparative D (Pentaerythritol tetra-3,5,5-trimethylhexanoate, ester with exceptional oxidative and hydrolytic stability available from Croda under PRIOLUBE™ 1965) were compared with the amides of Examples 1 and 2. The results are shown in Table 3 below.

TABLE 3

Hydrolytic and oxidative stability of neat materials

| Test material | ASTM D943 result, hours |
|---|---|
| Comparative A | 8 |
| Comparative B | 13 |
| Comparative C | 36 |
| Comparative D | 23 |
| Example 1 | 52 |
| Example 2 | 672* |

*Test still on-going at time of reporting, with current acid number 0.96 mg KOH ASTM D2619 determines the ability of a lubricant composition to resist hydrolysis. Compositions which are unstable to water under the conditions of the test form corrosive acidic and insoluble contaminants.

75 g of the lubricant composition to be tested, 25 g of water, and a polished copper strip were sealed in a bottle then placed in a 200° F. (93° C.) oven and rotated end for end at 5 rpm for 48 hrs. The values reported for each composition at the end of the test were Acid Number Change, Total Acidity of Water, Weight Change and Appearance of Copper Strip. The results are shown in Table 4 below.

In this example, the lubricant compositions used to evaluate hydrolytic stability were based on a standard gear oil and were formulated as follows:

10% mass of test material 87.35% mass of GR IV basestock (PAO)

2.65% mass of HITEC® 307 gear oil additive (Afton Chemical)

TABLE 4

Hydrolytic stability in industrial gear oil formulation.

| Test material, 10% in gear oil formulation | Change in Acid Number (ASTM D974, Organic layer, mg KOH) | Total Acidity of Water Layer (mg KOH) | Weight Change of Copper Panel (mg/cm$^3$) | Appearance of Copper Panel |
|---|---|---|---|---|
| Comparative A | 1.81 | 25.93 | 0.000 | Shiny 1B-2A |
| Comparative B | 1.41 | 25.96 | −0.375 | Shiny 1B |
| Comparative C | 0.63 | 15.75 | −0.058 | Shiny 1B-2A |
| Comparative D | 0.61 | 15.97 | −0.042 | Dull 4A |
| Example 1 | −0.27 | 15.75 | −0.033 | Shiny 1B-2A |
| Example 2 | −0.2 | 12.50 | 0.017 | Shiny 3A |

Example 15: Volatility Evaluation

The volatility of the neat test materials was measured according to test method ASTM D6375—09 Standard Test Method for Evaporation Loss of Lubricating Oils by Thermogravimetric Analyzer (TGA) Noack Method. Comparative Examples E (GRII Mineral oil (PURE PERFORMANCE® 110N, from Phillips 66 Co)) and F (PAO4 (SPECTRASYN™ 4, Exxon Chemicals)) were added to the test matrix for comparison. The results are shown in Table 5 below.

TABLE 5

NOACK Volatility and Kinetic Viscosity @100° C. (KV100) of the test materials.

| Test Material | ASTM D6375 (NOACK) weight loss, wt % | KV 100, cSt |
|---|---|---|
| Comparative A | 30 | 2.7 |
| Comparative B | 12 | 5.3 |
| Comparative C | 2.45 | 4.4 |
| Comparative D | 1.70 | 23 |
| Example 1 | 15.0 | 7.6 |
| Example 2 | 57.8 | 3.85 |
| Example 3 | 3.2 | 13.7 |
| Comparative E | 26.5 | 4.2 |
| Comparative F | 14.0 | 4.0 |

Example 16: Solubility of Additives

The relative solubilities of various lubricant additives were tested by blending the respective additives and additive packages into PAO 40 (SPECTRASYN™ 40, available from ExxonMobil Chemicals) along with a second base oil selected from the amides of Examples 1 and 2, esters of Comparatives B and C or PAO 4 (SPECTRASYN™ 4, available from ExxonMobil Chemicals). The blending was facilitated by stirring the lubricant base oils (PAO 40 and second base oil) and the additive, or additive package, at 65° C. for 1 hour with 600 RPM agitation. After blending was complete, the resulting oil samples were sealed in air-tight jars and stored for 30 days at 24° C. After once month (30 days) of storage, the lubricant samples were inspected visually and the appearances were recorded. The results are shown below in Tables 6, 7 and 8.

The additives tested were Glycerol Monooleate (GMO, available from Croda Inc as PRIOLUBE™ 1407), Molybdenum dialkyldithiocarbamate (MOLYVAN® 822, available from Vanderbilt Chemicals LLC), and an industrial gear oil package (HITEC® 307, available from Afton Chemical Corporation).

TABLE 6

Blends containing 1 wt % of Glycerol Monooleate (all numbers are wt %)

| PAO 4 | Comparative B | Comparative C | Example 1 | Example 2 | PAO40 | Solubility test results |
|---|---|---|---|---|---|---|
| 10 | | | | | 89 | Sediment |
| | 10 | | | | 89 | Slight haze |
| | | 10 | | | 89 | Slight haze |
| | | | 10 | | 89 | Clear |
| | | | | 10 | 89 | Clear |
| 5 | | | | | 94 | Sediment |
| | 5 | | | | 94 | Sediment |
| | | 5 | | | 94 | Sediment |
| | | | 5 | | 94 | Clear |
| | | | | 5 | 94 | Clear |

TABLE 7

Blends containing 1 wt % of Molybdenum dialkyldithiocarbamate (all numbers are wt %)

| PAO 4 | Comparative B | Comparative C | Example 1 | Example 2 | PAO40 | Solubility test results |
|---|---|---|---|---|---|---|
| 10 | | | | | 89 | Sediment |
| | 10 | | | | 89 | Slight haze |
| | | 10 | | | 89 | Slight haze |
| | | | 10 | | 89 | Clear |
| | | | | 10 | 89 | Clear |
| 5 | | | | | 94 | Sediment |
| | 5 | | | | 94 | Sediment |
| | | 5 | | | 94 | Slight Haze |
| | | | 5 | | 94 | Clear |
| | | | | 5 | 94 | Clear |

TABLE 8

Blends containing 2.65 wt % of HITEC ® 307 gear oil additive (all numbers are wt %)

| PAO 4 | Comparative B | Comparative C | Example 1 | Example 2 | PAO40 | Solubility test results |
|---|---|---|---|---|---|---|
| 10 | | | | | 87.35 | Separation |
| | 10 | | | | 87.35 | Slight haze |
| | | 10 | | | 87.35 | Clear |
| | | | 10 | | 87.35 | Clear |
| | | | | 10 | 87.35 | Clear |
| 5 | | | | | 92.35 | Separation |
| | 5 | | | | 92.35 | Haze |
| | | 5 | | | 92.35 | Slight Haze |
| | | | 5 | | 92.35 | Clear |
| | | | | 5 | 92.35 | Clear |

As described and shown by way of example above, the lubricant composition and amide, which is the reaction product of a secondary, branched amine and a carboxylic acid, of the present invention provide a commercially viable and enhanced alternative when compared to existing lubricant materials and compositions.

Example 17

Table 9 shows an exemplary grease composition that contains the amide of Example 1 as the base oil, lithium 12-hydroxystearate as the thickener and Hitec 343G as a conventional grease additive.

TABLE 9

Grease formulation

| Component | Function | % w/w |
|---|---|---|
| Hitec 343G | Multiple additives: anti-wear, extreme pressure and corrosion inhibition | 2.5 |
| Lithium 12-hydroxystearate (no saponification) | Thickener | 12 |
| Liquid Amide of Example 1 | Base Oil/Lubricant | 85.5 |

Example 18

An exemplary grease composition was prepared containing the amide of Example 6A as the base oil, lithium 12-hydroxystearate as the thickener and Hitec 343G as a conventional grease additive.

Example 19

Table 10 shows an exemplary grease composition that contains the amide of Example 8 as the solubiliser, lithium 12-hydroxystearate as the thickener and Hitec 343G as a conventional grease additive.

TABLE 10

| Grease formulation | | |
|---|---|---|
| Component | Function | % w/w |
| Hitec 343G | Multiple additives: anti-wear, extreme pressure and corrosion inhibition | 2.5 |
| Lithium 12-hydroxystearate (no saponification) | Thickener | 12 |
| PAO 40 | Base Oil/Lubricant | 65.5 |
| Liquid Amide of Example 8 | Solubiliser | 20 |

Example 20

Table 11 shows an exemplary grease composition that contains the amide of Example 3 as the solubiliser, lithium 12-hydroxystearate as the thickener and Hitec 343G as a conventional grease additive.

TABLE 11

| Grease formulation | | |
|---|---|---|
| Component | Function | % w/w |
| Hitec 343G | Multiple additives: anti-wear, extreme pressure and corrosion inhibition | 2.5 |
| Lithium 12-hydroxystearate (no saponification) | Thickener | 12 |
| Group III mineral oil | Base Oil/Lubricant | 75.5 |
| Liquid Amide of Example 3 | Solubiliser | 10 |

Example 21

Table 12 shows an exemplary grease composition that contains the amide of Example 7 as the solubiliser, lithium 12-hydroxystearate as the thickener, boric acid as the complexing agent, and Hitec 343G as a conventional grease additive.

TABLE 12

| Grease formulation | | |
|---|---|---|
| Component | Function | % w/w |
| Hitec 343G | Multiple additives: anti-wear, extreme pressure and corrosion inhibition | 3 |
| Lithium 12-hydroxystearate | Thickener | 10 |
| Boric acid | Complexing agent | 2 |
| Group III mineral oil | Base Oil/Lubricant | 65 |
| Liquid Amide of Example 7 | Solubiliser | 20 |

Example 22

Table 13 shows an exemplary grease composition that contains the amide of Example 4 as the solubiliser, lithium 12-hydroxystearate as the thickener, sebacic acid as the complexing agent, and Hitec 343G as a conventional grease additive.

TABLE 13

| Grease formulation | | |
|---|---|---|
| Component | Function | % w/w |
| Hitec 343G | Multiple additives: anti-wear, extreme pressure and corrosion inhibition | 3 |
| Lithium 12-hydroxystearate | Thickener | 10 |
| Sebacic acid | Complexing agent | 2 |
| Group II mineral oil | Base Oil/Lubricant | 75 |
| Liquid Amide of Example 4 | Solubiliser | 10 |

Example 23

Table 14 shows an exemplary grease composition that contains the amide of Example 1 as the solubiliser, calcium 12-hydroxystearate as the thickener, azelaic acid as the complexing agent, and Hitec 343G as a conventional grease additive.

TABLE 14

| Grease formulation | | |
|---|---|---|
| Component | Function | % w/w |
| Hitec 343G | Multiple additives: anti-wear, extreme pressure and corrosion inhibition | 3 |
| Calcium 12-hydroxystearate | Thickener | 10 |
| Azelaic acid | Complexing agent | 2 |
| Group III mineral oil | Base Oil/Lubricant | 65 |
| Liquid Amide of Example 1 | Solubiliser | 20 |

Example 24

Table 15 shows an exemplary grease composition that contains the amide of Example 5 as the solubiliser, aluminium stearate as the thickener, and K-CORR G-1031 as a rust and corrosion inhibitor.

TABLE 15

| Grease formulation | | |
|---|---|---|
| Component | Function | % w/w |
| K-CORR G-1031 | rust and corrosion inhibitor | 1.5 |
| Aluminium stearate | Thickener | 15.0 |
| PAO 40 | Base Oil/Lubricant | 63.5 |
| Liquid Amide of Example 5 | Solubiliser | 20.0 |

Example 25

Table 16 shows an exemplary grease composition that contains the amide of Example 9 as the solubiliser, calcium sulfonate and 12-hydroxystearic acid as the thickener, and boric acid as the complexing agent.

TABLE 16

| Grease formulation | | |
|---|---|---|
| Component | Function | % w/w |
| Additive package | Multiple additives: anti-wear, extreme pressure and corrosion inhibition | 9 |

TABLE 16-continued

| Grease formulation | | |
|---|---|---|
| Component | Function | % w/w |
| Boric acid | Complexing agent | 2 |
| Calcium sulfonate | Thickener | 39 |
| 12-Hydroxystearic acid | Thickener | 2 |
| PAO 40 | Base Oil/Lubricant | 28 |
| Liquid Amide of Example 9 | Solubiliser | 20 |

Example 26

Table 17 shows an exemplary grease composition that contains the amide of Example 2 as the solubiliser, alicyclic aliphatic diurea as the thickener and magnesium oxide as a conventional grease additive.

TABLE 17

| Grease formulation | | |
|---|---|---|
| Component | Function | % w/w |
| Magnesium oxide | Lubricant/friction modifier | 1.0 |
| Alicyclic aliphatic diurea | Thickener | 15 |
| Methyl phenyl silicone | Base Oil/Lubricant | 64 |
| Liquid Amide of Example 2 | Solubiliser | 20 |

Example 27

Table 18 shows an exemplary grease composition that contains the amide of Example 9 as the solubiliser, fumed silica as the thickener and a conventional grease additive.

TABLE 18

| Grease formulation | | |
|---|---|---|
| Component | Function | % w/w |
| Additive package | Multiple additives: anti-wear, extreme pressure and corrosion inhibition | 5 |
| Fumed silica | Thickener | 15 |
| Dimethyl polysiloxane | Base Oil/Lubricant | 70 |
| Liquid Amide of Example 9 | Solubiliser | 10 |

Example 28

Table 19 shows an exemplary grease composition that contains the amide of Example 1 as the solubiliser, fumed silica as the thickener and a conventional grease additive.

TABLE 19

| Grease formulation | | |
|---|---|---|
| Component | Function | % w/w |
| Additive | Multiple additives: anti-wear, extreme pressure and corrosion inhibition | 5 |
| Fumed silica | Thickener | 15 |
| Vegetable oils | Base Oil/Lubricant | 70 |
| Liquid Amide of Example 1 | Solubiliser | 10 |

Example 29

The types of additives which may be included in the grease formulations of the invention depend on the intended application of the grease and may be selected from those known in the art. Table 20 below provides an exemplary listing of suitable additives for various applications. The unexpectedly superior solubilizing properties associated with the amides of Formula (1a) and (1b) allow for the inclusion of various additives that result in high performance grease formulations.

TABLE 20

| Suitable Additives for Grease Formulations | | | | | |
|---|---|---|---|---|---|
| Additive | Journal Bearings | Ball Bearings | Thrust Bearings | Roller Bearings | Needle Bearings |
| Antioxidants | • | • | • | • | • |
| Antifoam Agents | • | • | • | • | • |
| Antiwear/EP | — | • | • | • | • |
| Rust Inhibitors | • | • | • | • | — |
| Extreme Pressure | — | — | — | — | — |
| Demulsibility | • | • | • | • | — |
| Corrosion Inhibitors | • | • | • | • | • |

• Typically Required

Any or all of the disclosed features, and/or any or all of the steps of any method or process described, may be combined in any combination.

Each feature disclosed herein may be replaced by alternative features serving the same, equivalent or similar purpose. Therefore, each feature disclosed is one example only of a generic series of equivalent or similar features.

The above statements apply unless expressly stated otherwise. The term specification, for these purposes, includes the description and any accompanying claims, abstract and drawings.

The invention claimed is:

1. A lubricating grease composition comprising:

a) a base oil comprising an amide which is a liquid at room temperature and which is the reaction product of a secondary, branched amine and a carboxylic acid, wherein the liquid amide is an amide of Formula (Ia) or (Ib):

(Ia)

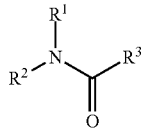

(Ib)

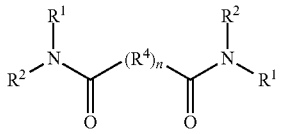

wherein:

$R^1$ and $R^2$ are independently selected from the group consisting of $C_3$ to $C_{18}$ linear or branched, saturated or unsaturated, hydrocarbyl groups, $R^3$ is selected from the group consisting of $C_3$ to $C_{50}$ linear or branched, saturated or unsaturated hydrocarbyl groups, $R^4$ is selected from the group consisting of $C_1$ to $C_{50}$ linear or branched, saturated or unsaturated hydrocarbylene groups, n is 0 or 1, at least one of $R^1$ and $R^2$ is branched, and 2 wt % to 20 wt % of the grease composition is the amide of Formula (Ia) and/or Formula (Ib), wherein the base oil further comprises an oil that is different from the amide of Formula (Ia) or (Ib) and that is 60 wt % to 90 wt % of the grease composition, wherein the amide of Formula (Ia) or (Ib) is/are the only amide component of the grease composition;

b) a thickener comprising a metal soap(s); and c) optionally at least one additive.

2. The grease composition according to claim 1, wherein the secondary, branched amine reactant has the formula (II):

(II)

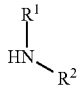

wherein $R^1$ and $R^2$ are independently selected from the group consisting of ($C_3$ to $C_{18}$ linear or branched, saturated or unsaturated, hydrocarbyl groups, and wherein at least one of $R^1$ and $R^2$ is branched.

3. The grease composition according to claim I, wherein the carboxylic acid is a monocarboxylic acid and the amine is a monoamine.

4. The grease composition according to claim 3, wherein the monocarboxylic acid comprises from 8 to 24 carbon atoms.

5. The grease composition according to claim 1, wherein the carboxylic acid is a. dicarboxylic acid and the amine is a di amine.

6. The grease composition according to claim 5, wherein the dicarboxylic acid comprises from 8 to 36 carbon atoms.

7. The grease composition according to claim 1, wherein the neat amide has a hydrolytic stability measured according to the method set out in ASTM D943 of at least 40 hours.

8. The grease composition according to claim 1, wherein the grease composition comprises at least 5 wt % and up to 30 wt % of the thickener based on the total weight of the composition.

9. The grease composition according to claim 1, wherein the base oil comprises 65 wt % to 85 wt % of the different oil based on the total weight of the composition.

10. A method of increasing the additive solubility or detergency of a grease composition which comprises adding to the grease composition:

a) an amide which is a liquid at room temperature and which is the reaction product of a secondary, branched amine and a carboxylic acid, wherein the liquid amide is an amide of Formula (Ia) or (Ib):

(Ia)

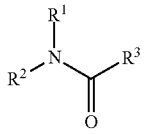

-continued (Ib)

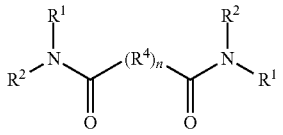

wherein:

$R^1$ and $R^2$ are independently selected from the group consisting of $C_3$ to $C_{18}$ linear or branched, saturated or unsaturated, hydrocarbyl groups, $R^3$ is selected from the group consisting of $C_3$ to $C_{50}$ linear or branched, saturated or unsaturated hydrocarbyl groups, $R^4$ is selected from the group consisting of $C_1$ to $C_{50}$ linear or branched, saturated or unsaturated hydrocarbylene groups, n is 0 or 1, at least one of $R^1$ and $R^2$ is branched;

b) a thickener comprising a metal soap; and c) optionally at least one additive;

to form a modified grease composition, wherein the 2 wt % to 20 wt % of the modified grease composition is the amide of Formula (Ia) and/or Formula (Ib) wherein the modified grease composition comprises an oil that is different from the amide of Formula (Ia) or (Ib) and that is 60 wt % to 90 wt % of the modified grease composition, and wherein the amide of Formula (Ia) or (Ib) is/are the only amide component of the modified grease composition.

11. The lubricating grease composition of claim 1, further comprising an anti-oxidant that is 0.01 to 20 wt % of the lubricant grease composition, the anti-oxidant comprising a phenolic anti-oxidant, an aikylated diphenylarnine, a phenyl alpha napthylamine, a metal dithiocarbamate, methylenebis (dibutyldithiocarbamate), a molybdenum dialkyldithiocarbamate, or a combination thereof.

12. The lubricating grease composition of claim 11, wherein the anti-oxidant is a molybdenum dialkyldithiocarbamate, and wherein the anti-oxidant is 0.2 wt % to 2 wt % of the lubricant grease composition.

13. The lubricating grease composition of claim 1, further comprising a complexing agent comprising boric acid or a dicarboxylic acid.

14. The lubricating grease composition of claim 13, wherein the complexing agent is boric acid, glutaric acid, adipic acid, pimelic acid, octane dioic acid, sebacic acid, dodecanedioic acid, azelaic acid, or a combination thereof.

15. A lubricating grease composition comprising:

a) a base oil comprising an amide which is a liquid at room temperature and which is the reaction product of a secondary, branched amine and a carboxylic acid, wherein the liquid amide is an amide of Formula (Ia) or (Ib):

(Ia)

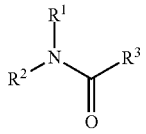

-continued (Ib)

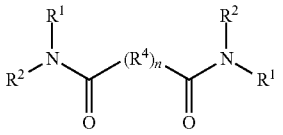

wherein:

$R^1$ and $R^2$ are independently selected from the group consisting of an isopropyl group and a $C_3$ to $C_{18}$ branched, saturated or unsaturated, hydrocarbyl groups, $R^3$ is selected from the group consisting of $C_3$ to $C_{23}$ linear or branched, saturated or unsaturated hydrocarbyl groups, $R^4$ is selected from the group consisting of $C_1$ to $C_{12}$ linear or branched, saturated or unsaturated hydrocarbylene groups, n is 0 or 1, and 2 wt % to 20 wt % of the grease composition is the amide of Formula (Ia) and/or Formula (Ib), wherein the base oil further comprises an oil that is different from the amide of Formula (Ia) or (Ib) and that is 60 wt % to 90 wt % of the grease composition, wherein the amide of Formula (Ia) or (Ib) is/are the only amide component of the grease composition;

b) a thickener comprising a metal soap(s); and c) 0.2 wt % to 2 wt % based on the total weight of the grease composition of at least one additive that is a molybdenum dialkyldithiocarbamate.

* * * * *